US010227115B2

(12) United States Patent
Merchant et al.

(10) Patent No.: US 10,227,115 B2
(45) Date of Patent: Mar. 12, 2019

(54) SUBMERSIBLE VESSEL FOR DRY DOCKING A VESSEL

(71) Applicant: Keppel Offshore & Marine Technology Centre Pte Ltd, Singapore (SG)

(72) Inventors: Aziz Amirali Merchant, Singapore (SG); Woei Siong Chong, Singapore (SG); Shahnas Riza Ahmad, Singapore (SG); Anis Altaf Hussain, Singapore (SG); Murthy S. Pasumarthy, Singapore (SG); Chong Yong Huang, Singapore (SG)

(73) Assignee: Keppel Offshore & Marine Technology Centre Pte Ltd, Singapore (SG)

( * ) Notice: Subject to any disclaimer, the term of this patent is extended or adjusted under 35 U.S.C. 154(b) by 0 days.

(21) Appl. No.: 15/526,674

(22) PCT Filed: Nov. 18, 2014

(86) PCT No.: PCT/SG2014/000542
§ 371 (c)(1),
(2) Date: May 12, 2017

(87) PCT Pub. No.: WO2016/080904
PCT Pub. Date: May 26, 2016

(65) Prior Publication Data
US 2017/0313394 A1 Nov. 2, 2017

(51) Int. Cl.
*B63C 1/02* (2006.01)
*B63B 35/42* (2006.01)
(Continued)

(52) U.S. Cl.
CPC ..... *B63C 1/02* (2013.01); *B63B 35/28* (2013.01); *B63B 35/42* (2013.01); *B63C 1/06* (2013.01); *B63B 2207/02* (2013.01)

(58) Field of Classification Search
CPC .. B63C 1/02; B63C 1/06; B63B 35/28; B63B 35/42
See application file for complete search history.

(56) References Cited

U.S. PATENT DOCUMENTS 4,381,723 A * 5/1983 Furst ..... B63C 3/02 114/45
6,409,431 B1 * 6/2002 Lynch ..... B63B 43/00 114/263

(Continued)

FOREIGN PATENT DOCUMENTS

WO WO 2013160768 A1 * 10/2013 ..... B63C 1/04
WO WO-2013160768 A1 * 10/2013 ..... B63C 1/04

*Primary Examiner* — S. Joseph Morano
*Assistant Examiner* — Jovon E Hayes
(74) *Attorney, Agent, or Firm* — Klein, O'Neill & Singh, LLP

(57) ABSTRACT

This invention relates to a submersible vessel for dry docking a vessel. The submersible vessel comprises a floating unit, a deck above the floating unit and a number of stabilizing towers arranged on the deck. The deck has a base, a sidewall along a perimeter of the base and a block provided within the sidewall and resting on the base, defining a cavity such that when the vessel is being docked onto the deck, a thruster of the vessel is above the cavity.

11 Claims, 17 Drawing Sheets

(51) Int. Cl.
*B63B 35/28* (2006.01)
*B63C 1/06* (2006.01)

(56) References Cited

U.S. PATENT DOCUMENTS

2003/0140837 A1* 7/2003 O'Neil ..... B63B 35/42
114/259
2017/0313394 A1* 11/2017 Merchant ..... B63C 1/02

* cited by examiner

SUBMERSIBLE VESSEL FOR DRY DOCKING A VESSEL

CROSS REFERENCE TO RELATED APPLICATIONS

This application is a national stage of Application No. PCT/SG2014/000542, entitled A Submersible Vessel for Dry Docking a Vessel, filed Nov. 18, 2014, the disclosure of which is hereby incorporated by reference in its entirety.

FIELD OF THE INVENTION

This invention relates to a submersible vessel for dry docking a vessel. Particularly, this invention relates to a submersible vessel for dry docking a vessel with thrusters. More particularly, this invention relates to a submersible vessel having a main deck configured for dry docking a vessel with thrusters.

PRIOR ART

It is known that most drill ships and semi-submersible vessels have thrusters that are fixedly secured to their hull. Therefore, in order for such vessels to be docked onto a barge to facilitate offshore repair work, the thrusters have to be removed from the hull prior to docking onto the barge. However, such removable of the thrusters are costly and time consuming as experienced divers and expensive equipment are required to remove the thrusters from the hull of the vessels. Thus, those skilled in the art are striving to provide an improved barge to facilitate docking of a vessel without a need to remove the thrusters.

SUMMARY OF THE INVENTION

The above and other problems are solved and an advance in the art is made by a submersible vessel in accordance with this invention. A first advantage of a submersible vessel in accordance with this invention is that the submersible vessel allows docking of a vessel without a need to remove the thrusters. A second advantage of a submersible vessel in accordance with this invention is that the submersible vessel can be easily customised to accommodate the position of the thrusters of the vessels to be docked onto the submersible vessel. This allows the submersible vessel to be configurable for use with various types of drill ships and semi-submersible vessels.

In accordance with embodiments of this invention, a submersible vessel for dry docking a vessel is configured in the following manner. The submersible vessel includes a floating unit, a deck above the floating unit, and a number of stabilizing towers arranged on the deck. The deck has a base, a sidewall along a perimeter of the base and a block provided within the sidewall and resting on the base. The block defines a cavity such that when the vessel is being docked on the deck, a thruster of the vessel is above the cavity.

In accordance with embodiments of this invention, the deck further comprises a number of blocks defining a number of cavities. Preferably, truss structures are provided to cover unused open hatches.

In accordance with embodiments of this invention, the base is rectangular in shape having rounded edges and the stabilizing towers are arranged at each of the corners of the base.

In accordance with embodiments of this invention, the blocks are identical in dimension. In accordance with another embodiment, each of the blocks includes rollers.

In accordance with embodiments of this invention, the deck further comprises guide rails arranged on the base and rollers arranged on each of the plurality of blocks and coupled to the guide rails such that each of the blocks is slidably movable on the base. Preferably, the blocks are made of steel.

In accordance with embodiments of this invention, the deck further comprises securing means for securing the blocks to the base.

In accordance with embodiments of this invention, the floating unit is a pontoon.

BRIEF DESCRIPTION OF THE DRAWINGS

The above and other features and advantages in accordance with this invention are described in the following detailed description and are shown in the following drawings.

DETAILED DESCRIPTION

This invention relates to a submersible vessel for dry docking a vessel. Particularly, this invention relates to a submersible vessel for dry docking a vessel with thrusters. More particularly, this invention relates to a submersible vessel having a main deck configured for dry docking a vessel with thrusters.

Figure 1:
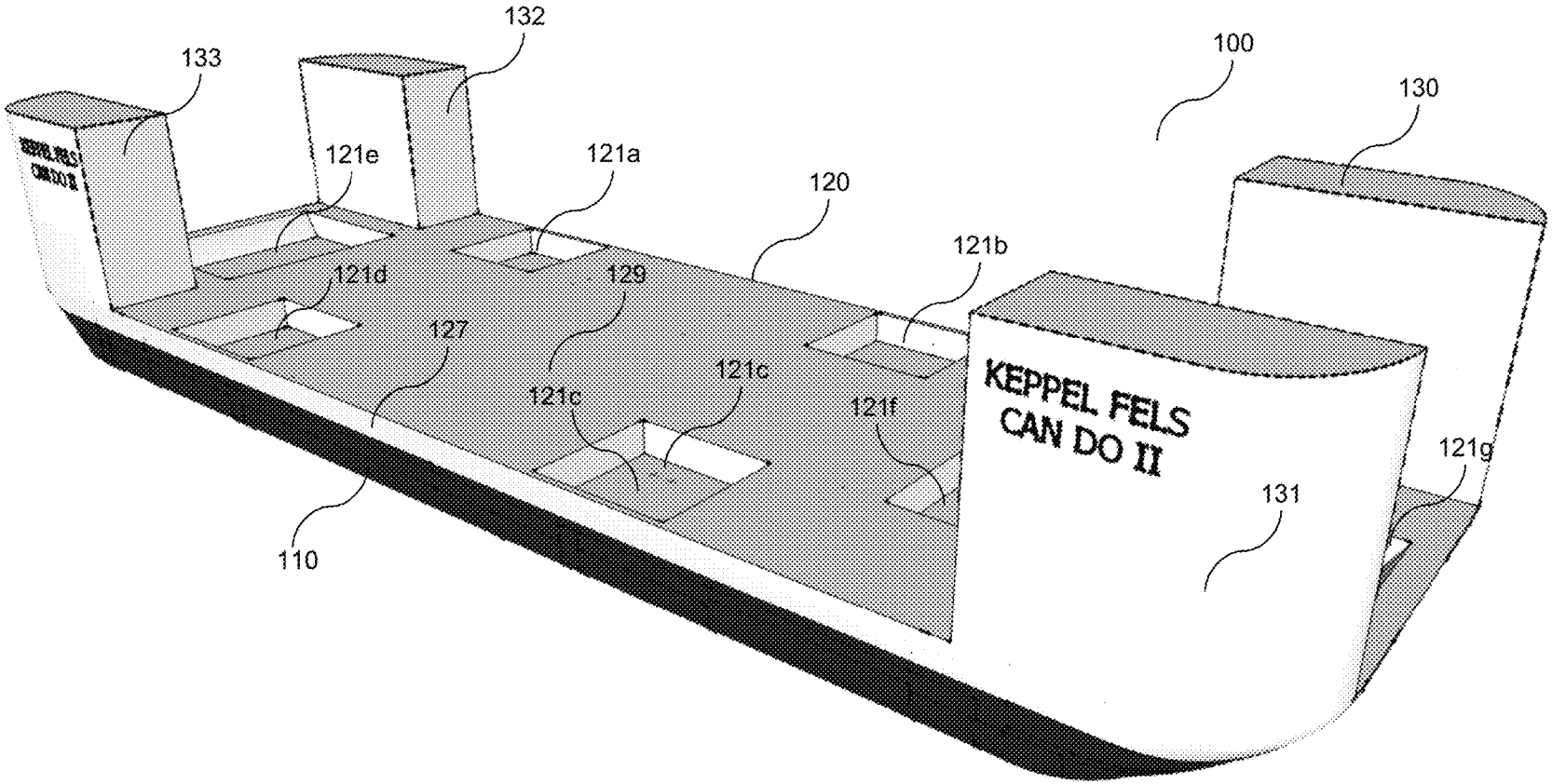
FIG. 1 illustrating a perspective view of a submersible vessel in accordance with an embodiment of this invention.

FIG. 1 shows a perspective view of a submersible vessel 100 for dry docking a vessel. The submersible vessel 100 is a barge for dry docking of vessels such as drill ships, semi-submersibles, or jack-ups for repair works. Other possible use of the submersible vessel 100 includes transportation of modules, mega block load out and offshore installation. The submersible vessel 100 includes a floating unit 110, a deck 120 and stabilizing towers 130-133.

The floating unit 110 is a pontoon or the like that houses a number of ballast tanks, passage ways and pump rooms. The ballast tanks are arranged in the floating unit 110 for controlling the buoyancy of the floating unit 110. By controlling the ballast tank, the submersible vessel 100 can be submerged to a required depth in order for a vessel to move to a designated loading position that is above the deck 120 of the submersible vessel 100. The floating unit 110 has a depth of 10 meters.

Figure 2:
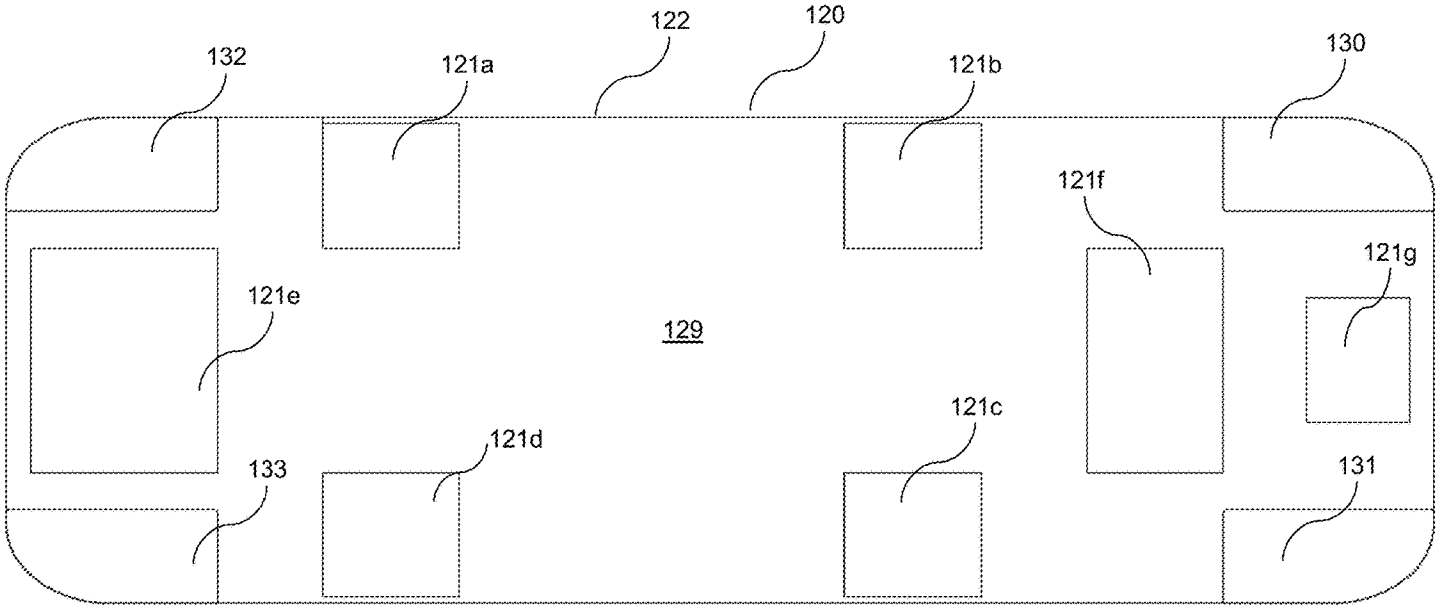
FIG. 2 illustrating a view from the top of the submersible vessel in accordance with an embodiment of this invention.

The deck 120 is above the floating unit 110. Particularly, the deck 120 rests on a surface of the floating unit 110. The floating unit 110 together with the deck 120 form the hull of the submersible vessel 100. FIG. 2 shows a view from the top of the submersible vessel 100. The deck 120 includes a base 128, a sidewall 127 along a perimeter 122 of the base 128 and a block 129 defining a number of cavities 121*a*-121*g* to accommodate thruster of a vessel when being docked onto the deck 120. The base 128 covers the top surface of the floating unit 110. The base 128 is rectangular in shape having rounded corners. The sidewall 127 runs along the perimeter of the base 128 and the block 129 is provided within the sidewall 127 and resting on the base 128. The cavities 121*a*-121*g* are strategically defined by the block 129 to accommodate the locations of the thrusters of most drill ships and semi-submersible vessels. Particularly, the cavities 121*a*-121*d* are defined by the block 129 on opposing sides (i.e. port and starboard) of the deck 120 in order to accommodate the thrusters of a typical semi-submersible vessel while the cavities 121*e*, 121*f* and 121*g* are defined by the block 129 proximate opposing ends (i.e. bow and stern) of the deck 120 in order to accommodate the thrusters of a typical drill ship. One skilled in the art will recognise that the cavities may be provided at positions other than those shown in FIG. 1 and the exact configuration is left to those skilled in the art. The deck 120 has a width of 78 meters, a length of 230 meters and a depth of 5 meters. This dimension is configured as such to accommodate the size of most drill ships and semi-submersible vessels. Nevertheless, one skilled in the art will recognise that other dimensions may be provided without departing from the invention.

Figure 3:
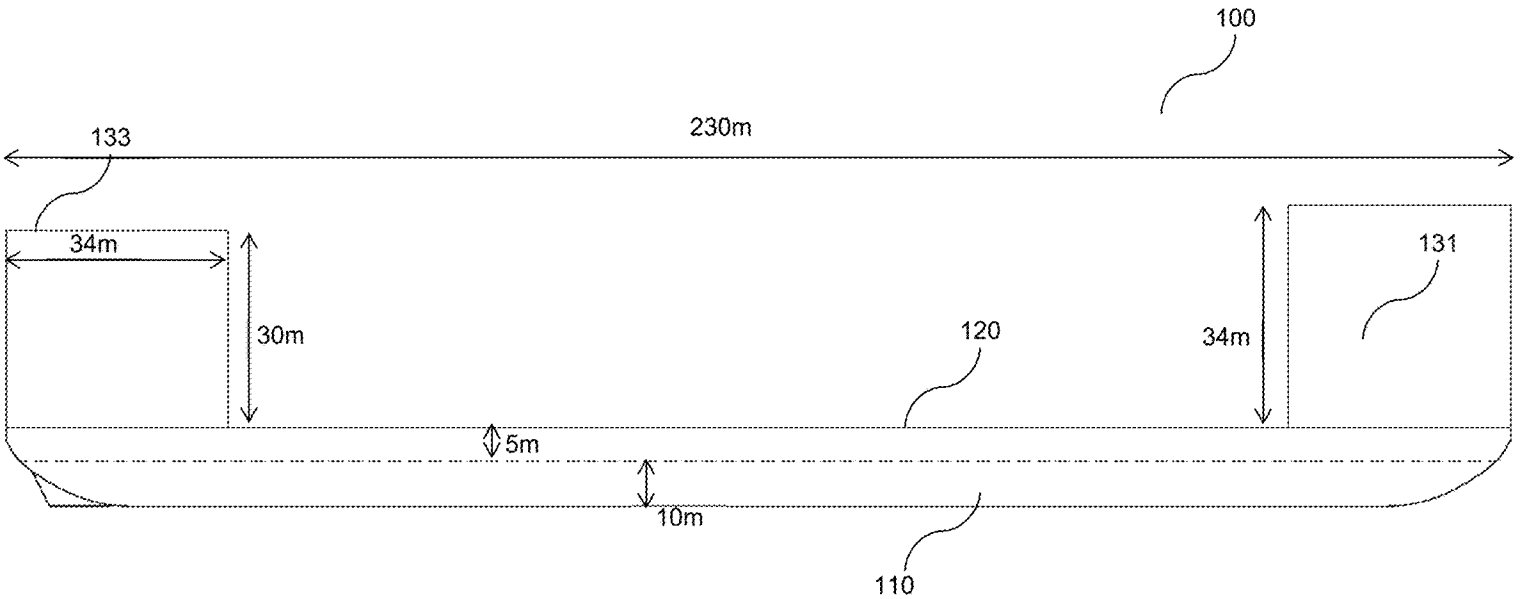
FIG. 3 illustrating a view from the side of the submersible vessel in accordance with an embodiment of this invention FIG. 4 illustrating a view from the front and rear of the submersible vessel in accordance with an embodiment of this invention FIG. 5 illustrating a perspective view of another submersible vessel in accordance with an embodiment of this invention.

The stabilizing towers 130-133 are provided at the four corners of the deck 120 and each stabilising towers has a height of between 30-35 meters. Particularly, as illustrated by the side view of the submersible vessel 100 as shown in FIG. 3, stabilising towers 130 and 131 are 34 meters from the deck 120 while the stabilizing towers 132 and 133 are 30 meters from the deck 120. Each of the stabilising towers has a width of 21 meters and a length of 34 meters as illustrated by the front view 410 and rear view 420 of the submersible vessel 100. One skill in the art will recognise that other heights may be implemented without departing from the invention. The stabilizing towers 130-133 are columns for stabilising the submersible vessel 100. The stabilizing towers 130-133 also act as a guide to guide a load (i.e. drill ship or semi-submersible vessel) to a designated loading position.

Figure 4:
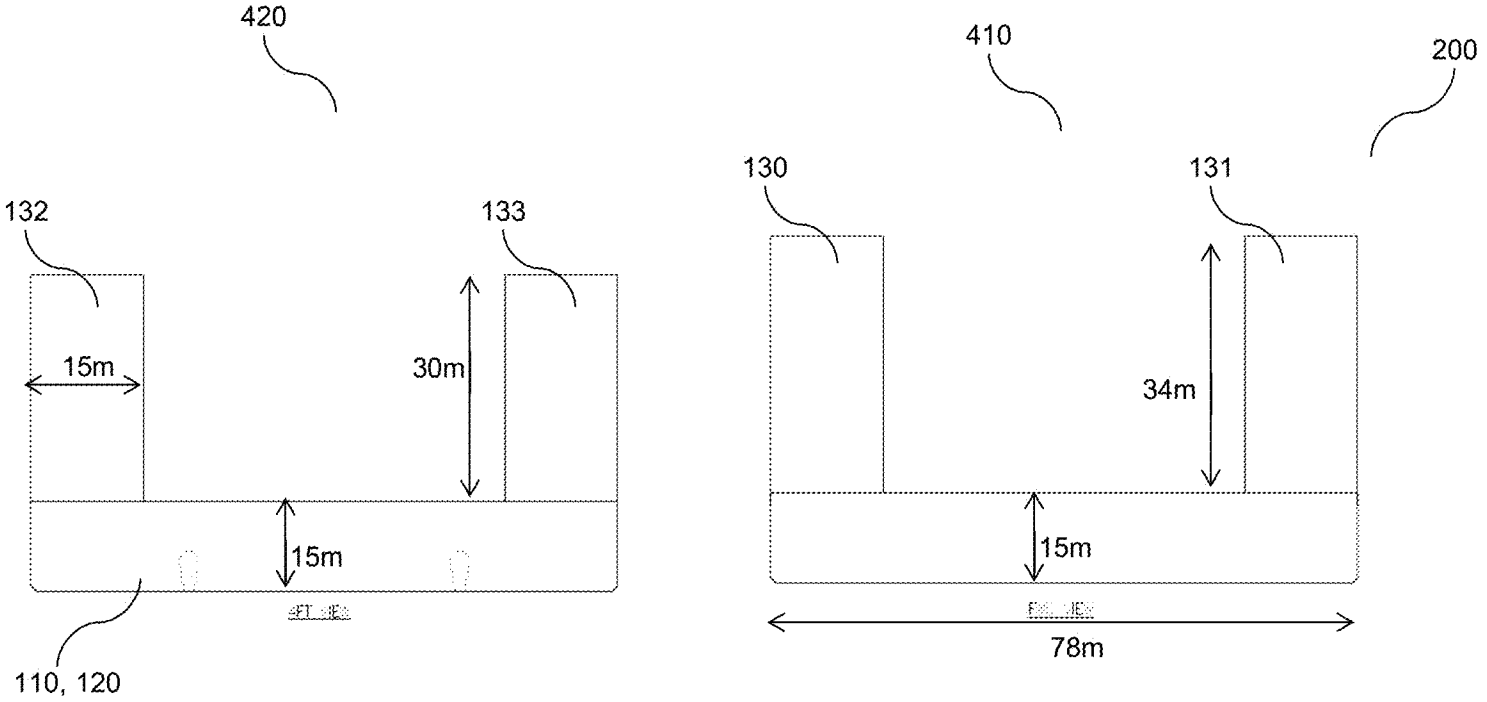

FIGS. 2-4 are not drawn according to scale and are only meant to show the dimensions of the submersible vessels 100. One skilled in the art will recognise that other dimensions may be implemented without departing from the invention.

Figure 5:
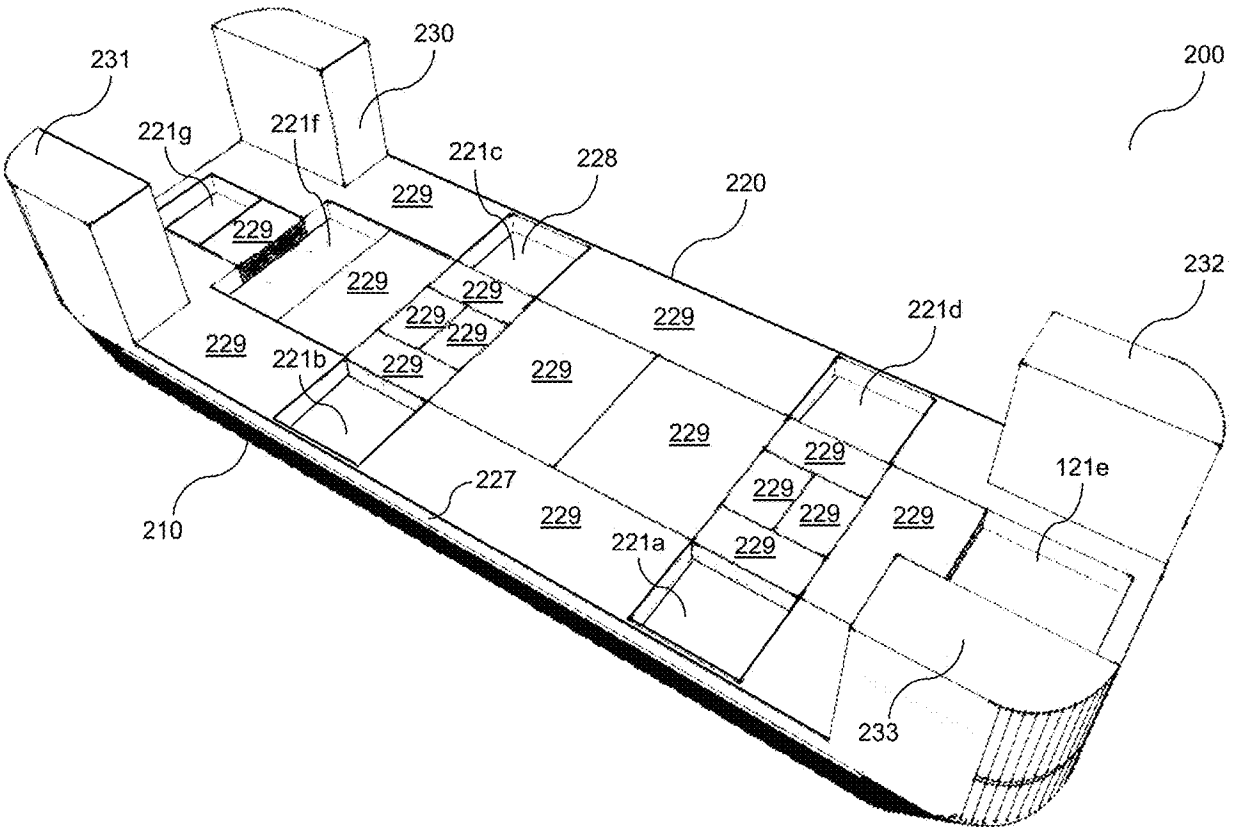

FIG. 5 shows another embodiment of a submersible vessel 200. Similar to the submersible vessel 100, the submersible vessel 200 also includes a floating unit 210, a deck 220 and four stabilizing towers 230-233. The only difference between the submersible vessel 200 and submersible vessel 100 is the arrangement of the block 129. The deck 220 of submersible vessel 200 includes a base 228 and a sidewall 227 along a perimeter of the base 228. The base 228 covers the top surface of the floating unit 210. The sidewall 227 runs along the perimeter of the base 228. A number of blocks 229 are provided within the sidewall 227 and resting on the base 228. The blocks 229 define a number of cavities 221*a*-221*g* to accommodate thruster of a vessel when being docked onto the deck 220.

The blocks 229 include securing means for securing onto the base 228 so that when submerged, the blocks 229 will not be disengaged from the base 228. The blocks 229 may be steel blocks or other materials that are capable of withstanding harsh conditions. The blocks 229 may further include rings in order to be hoisted and moved to a required position within the sidewall 227 and base 228 by a crane or pulley system. Alternatively, rollers are provided on the blocks 229 so that the blocks 229 are movable on the surface of the base 228. In yet another embodiment, guide rails may be provided on the surface of the base 228 to co-operate with the rollers on the blocks 229 so that the blocks 229 are movable on the surface of the base 228. One skilled in the art will recognise that other arrangement for securing and moving the blocks 229 on the base 228 may be implemented without departing from the invention.

Figure 6:
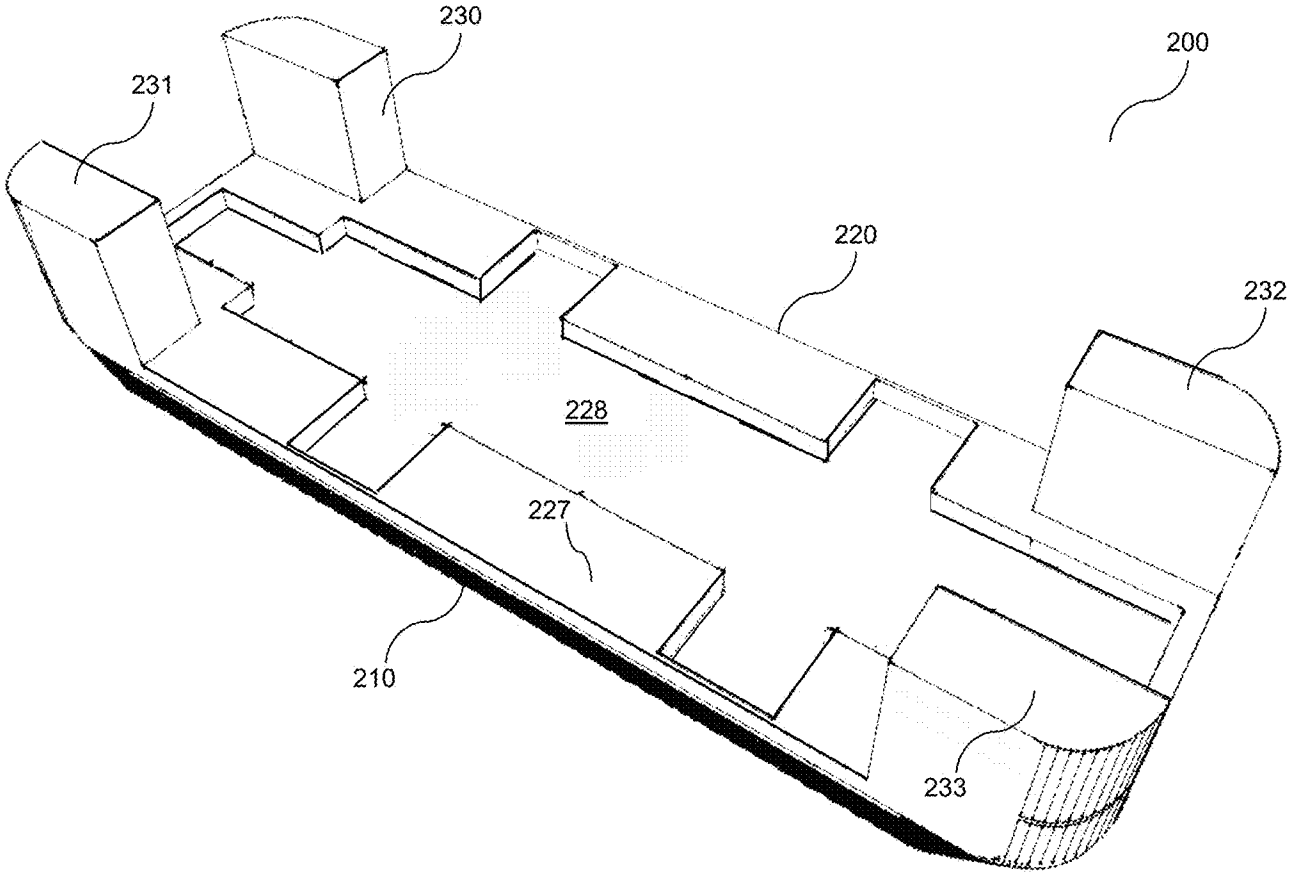
FIG. 6 illustrating a perspective view of the submersible vessel without the blocks in accordance with an embodiment of this invention.

FIG. 6 shows another embodiment of submersible vessel 200 where the sidewall 227 extends inwardly defining an internal perimeter where blocks 229 can be arranged therein. Particularly, the blocks 229 are arranged within the cavity defined by the internal perimeter. This allows the submersible vessel 200 to be configurable to accommodate the structure of the vessel to be loaded onto the deck 220. Particularly, the blocks 229 can be moved to required positions so that the vessel can be loaded onto the deck 220 without removing the thruster or thrusters of the vessel.

Figure 7:
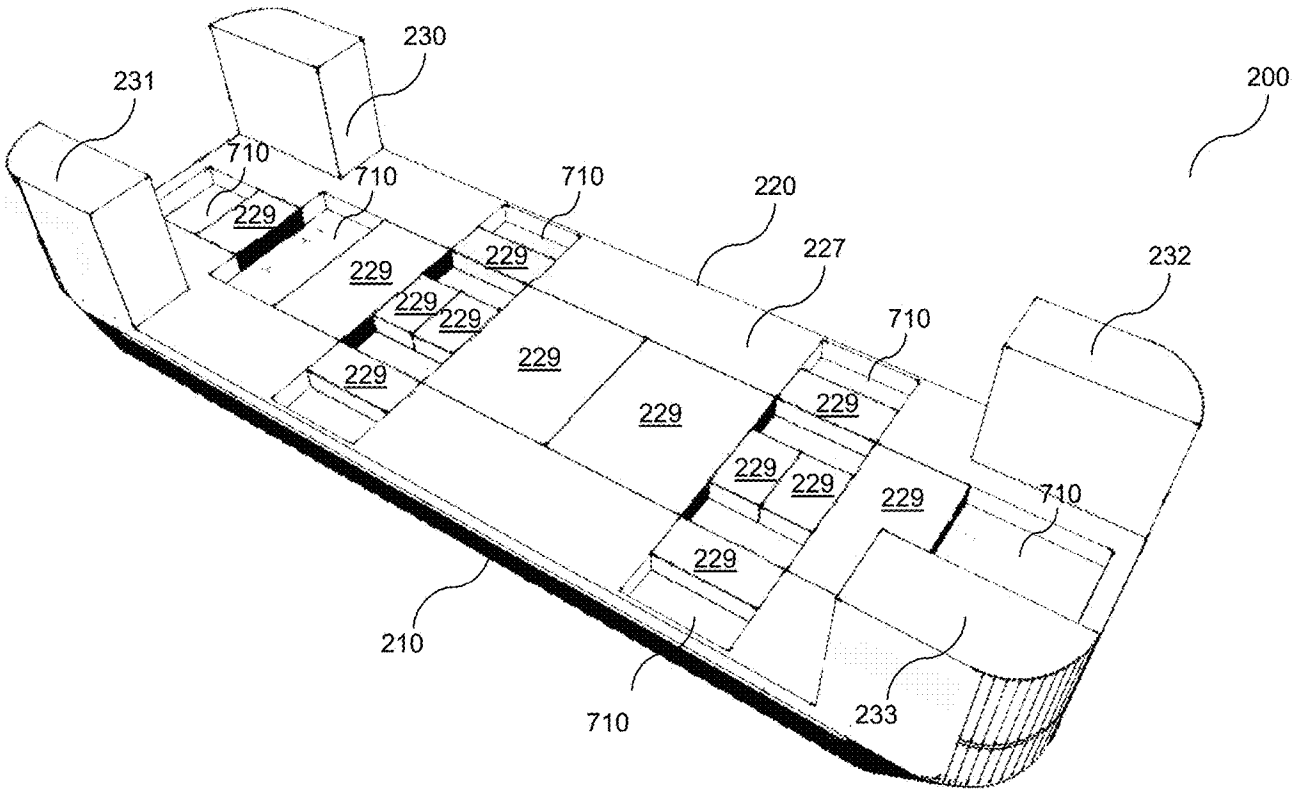
FIG. 7 illustrating a perspective view of the submersible vessel with the blocks in another arrangement in accordance with an embodiment of this invention.
Figure 8:
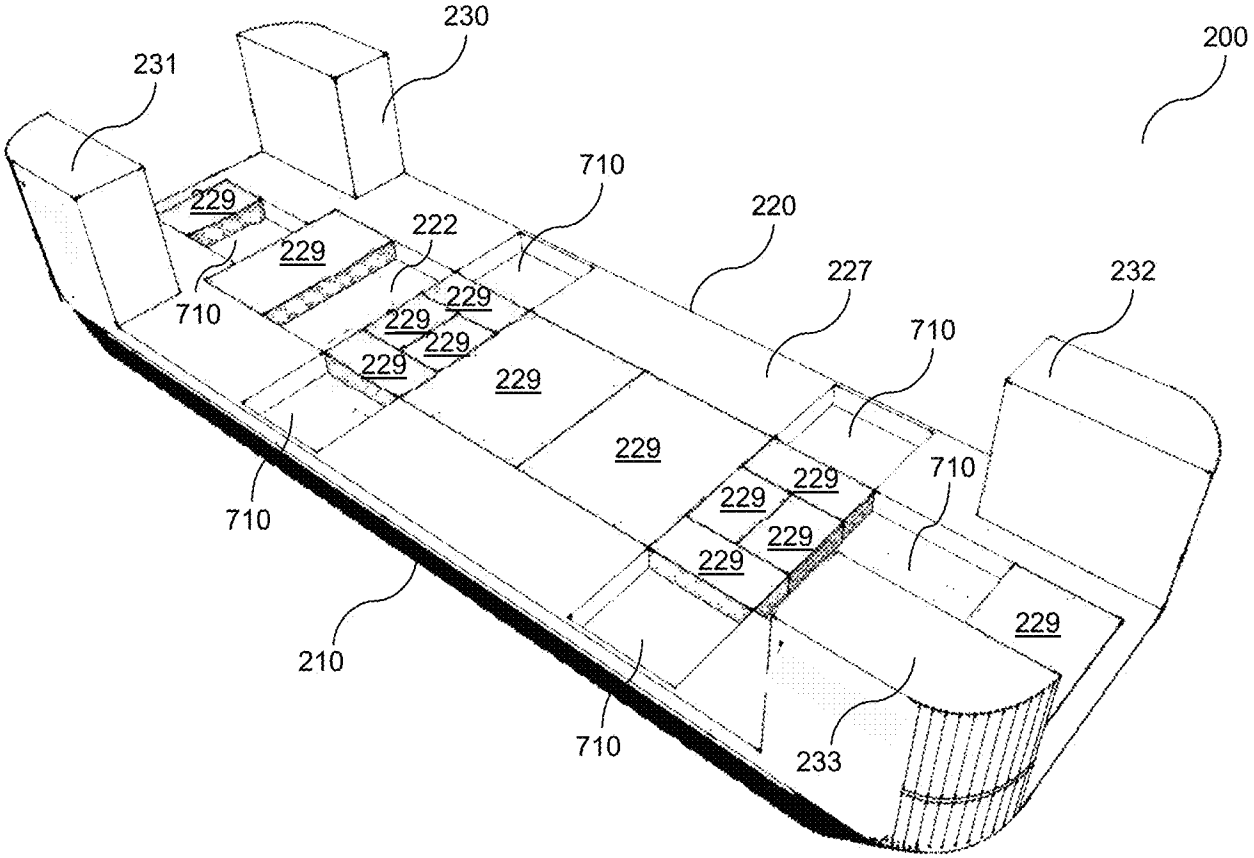
FIG. 8 illustrating a perspective view of the submersible vessel with the blocks in yet another arrangement in accordance with an embodiment of this invention.

FIGS. 7 and 8 show different arrangements of the blocks 229 within the cavity defined by the internal perimeter. FIGS. 7 and 8 show that the blocks 229 have three different dimensions. This allows the blocks 229 the flexibility to be arranged within the cavity defined by the internal perimeter to divide the cavity into open hatches or smaller cavities 710. Although FIGS. 7 and 8 show that the blocks 229 have three different dimensions, one skilled in the art will recognise any other different number of dimensions may be implemented without departing from the invention. Alternatively, the blocks 229 may be identical without departing from the invention.

Figure 9:
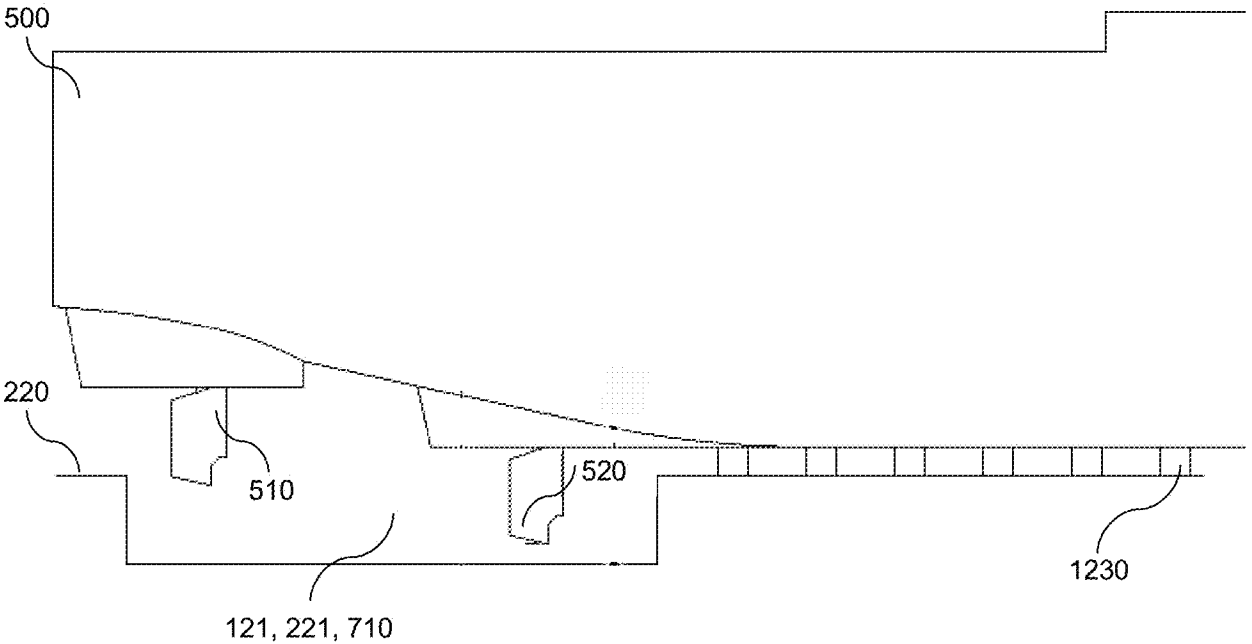
FIG. 9 illustrating partial view of an example of the thrusters being positioned above the cavity of the submersible vessel in accordance with an embodiment of this invention.

FIG. 9 shows an example of the position of the thrusters of a vessel when docked onto the deck of the submersible vessel 100. As shown in FIG. 9, the lower ends of the thruster 510 and 520 are lower than the bottom of the hull of the vessel 500. Hence, if cavity 121, 221 or 710 is not provided, the thrusters 510 and 520 have to be removed from the vessel 500 prior to docking.

Figure 10:
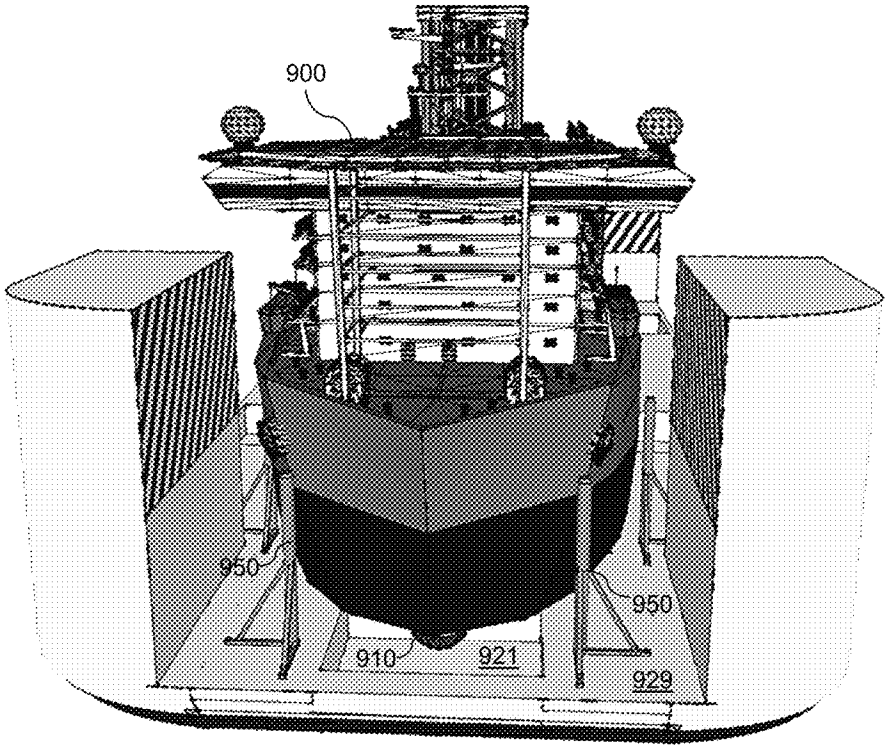
FIG. 10 illustrating a perspective view of a vessel being dock on the submersible vessel in accordance with an embodiment of this invention.
Figure 11:
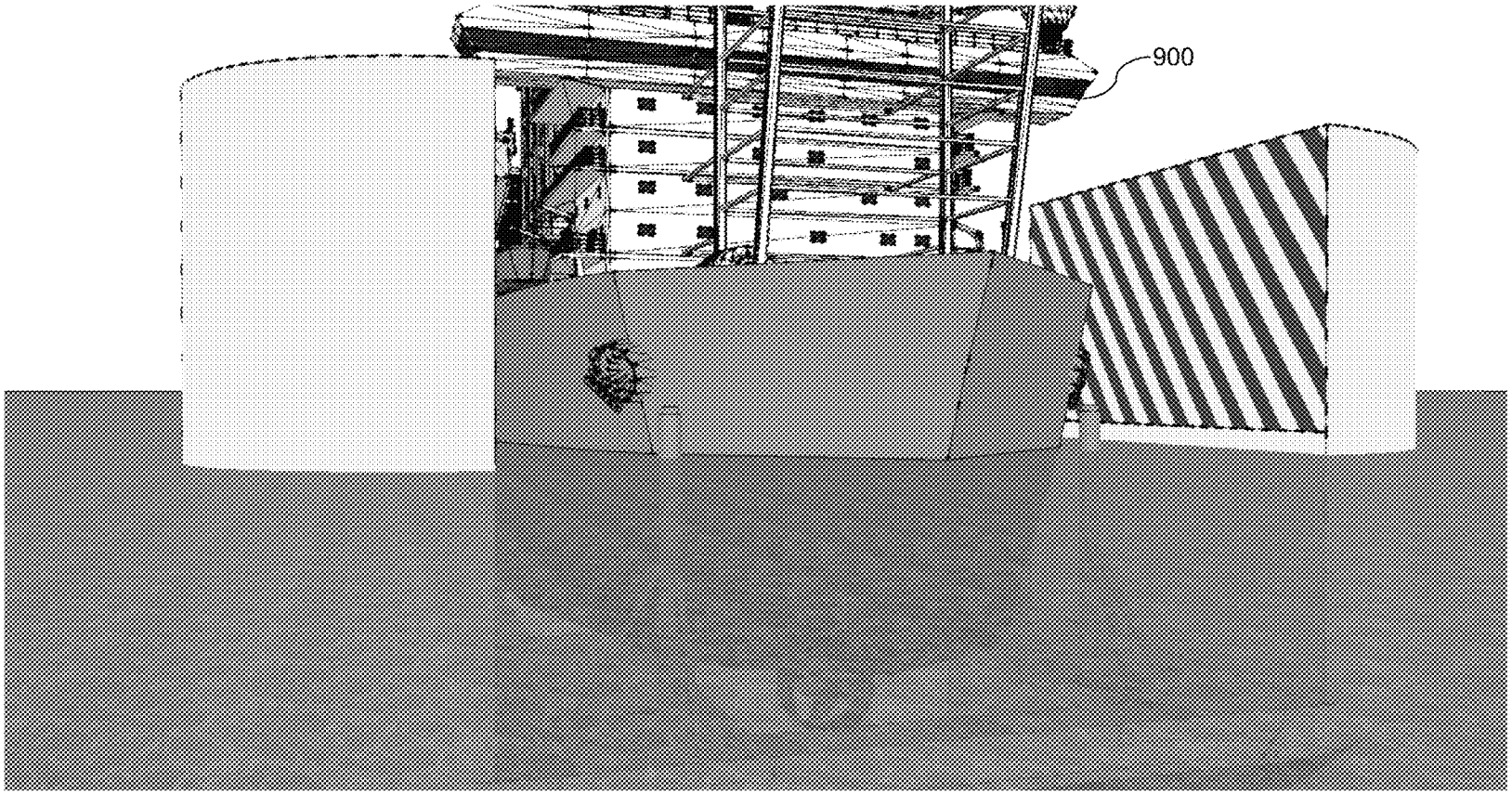
FIG. 11 illustrating another perspective view of the vessel being moved to a required position above the deck of the submersible vessel in accordance with an embodiment of this invention.

FIGS. 10 and 11 illustrate a vessel 900 being docked on the deck of submersible vessel 100. As shown in FIG. 11, the submersible vessel 100 is partially submerged in order for vessel 900 to move to the required position above the deck marked by the stanchions or markers 950. FIG. 10 shows the vessel 900 being docked onto the submersible vessel 100 or 200 where the thruster 910 is positioned above the cavity 921 defined by the block 929.

Figure 12:
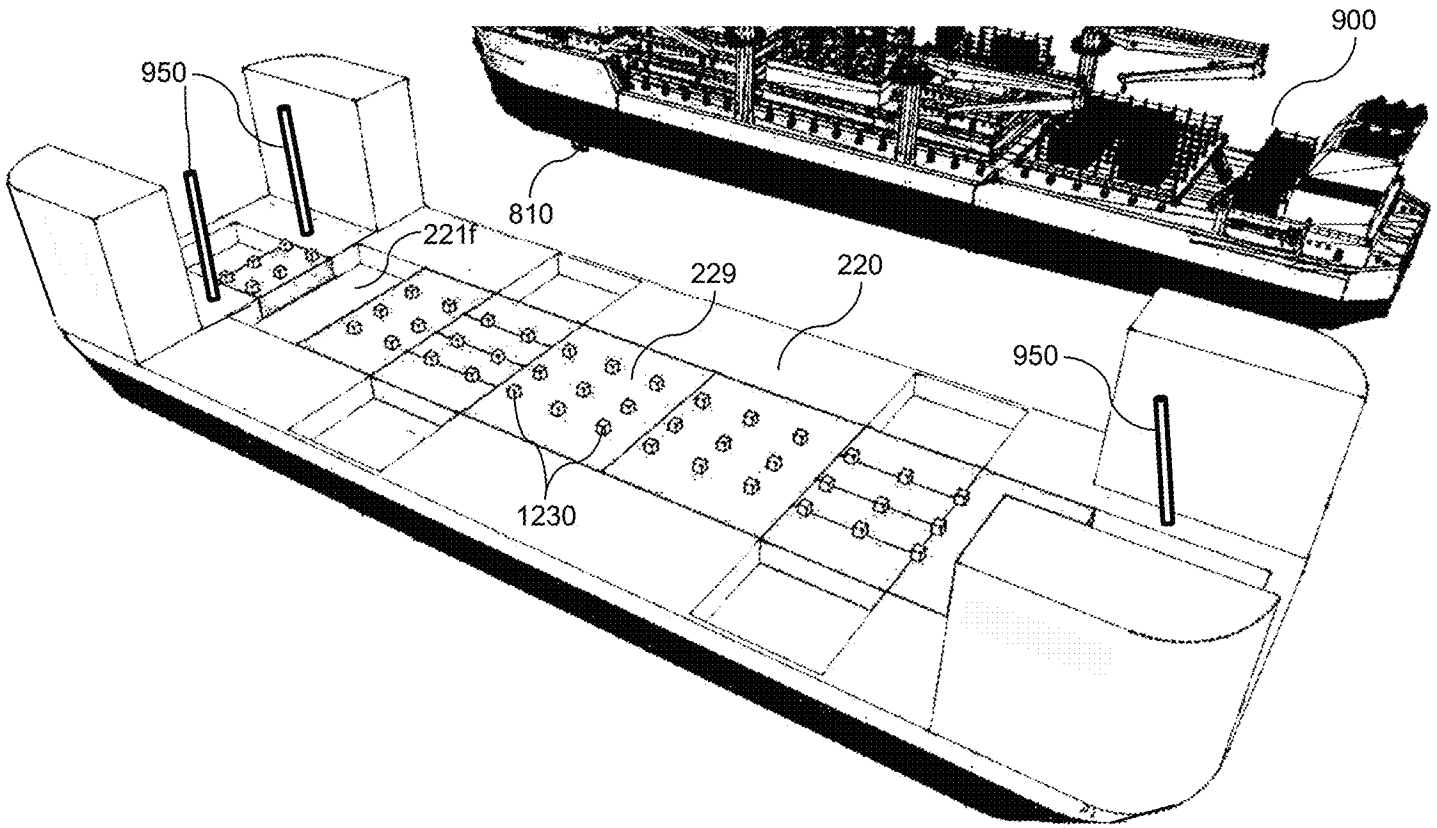
FIG. 12 illustrating a perspective view of the submersible vessel with the deck being prepared for docking of a vessel in accordance with an embodiment of this invention.
Figure 13:
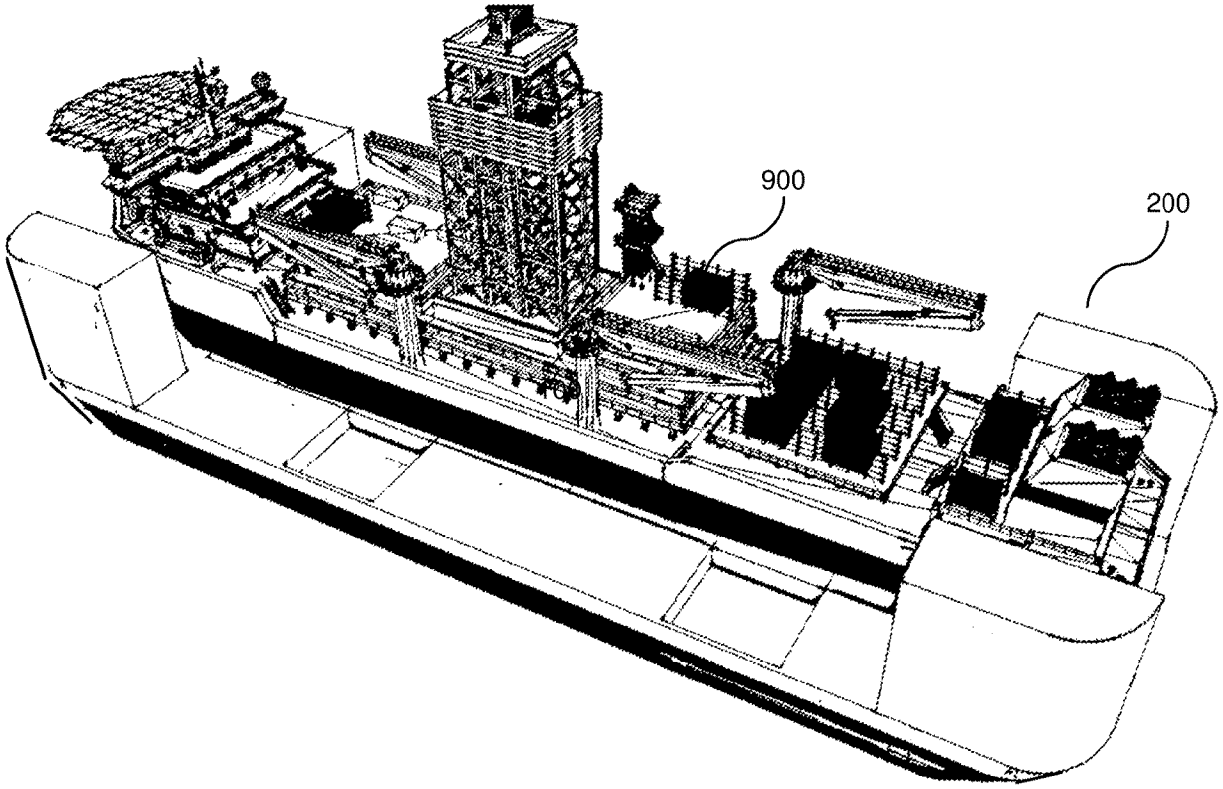
FIG. 13 illustrating a perspective view of the vessel being docked onto the submersible vessel in accordance with an embodiment of this invention.

FIGS. 12 and 13 illustrate vessel 900 being docked on the deck 220 of the submersible vessel 200. As shown in FIG. 12, the blocks 229 are moved to the required setup according to the vessel 900. Particularly, the blocks 229 are moved to a particular setup to create an open hatch 221*f* to accommodate the thruster 910 of vessel 900. Keel blocks 1230 are laid on the blocks 229 and stanchion or markers 950 are arranged on the deck 220. FIG. 13 shows the vessel 900 being docked onto the deck 220 of the submersible vessel 200. The open hatches or cavities 229 on the deck are designed to accommodate offshore vessels with fixed thruster types that will protrude. When any of the hatches are not in use, an ergonomic and safe work space can be created by laying truss structures into these open hatches such that top of the truss structures will be flushed with the top surface of the blocks 229.

Figure 14:
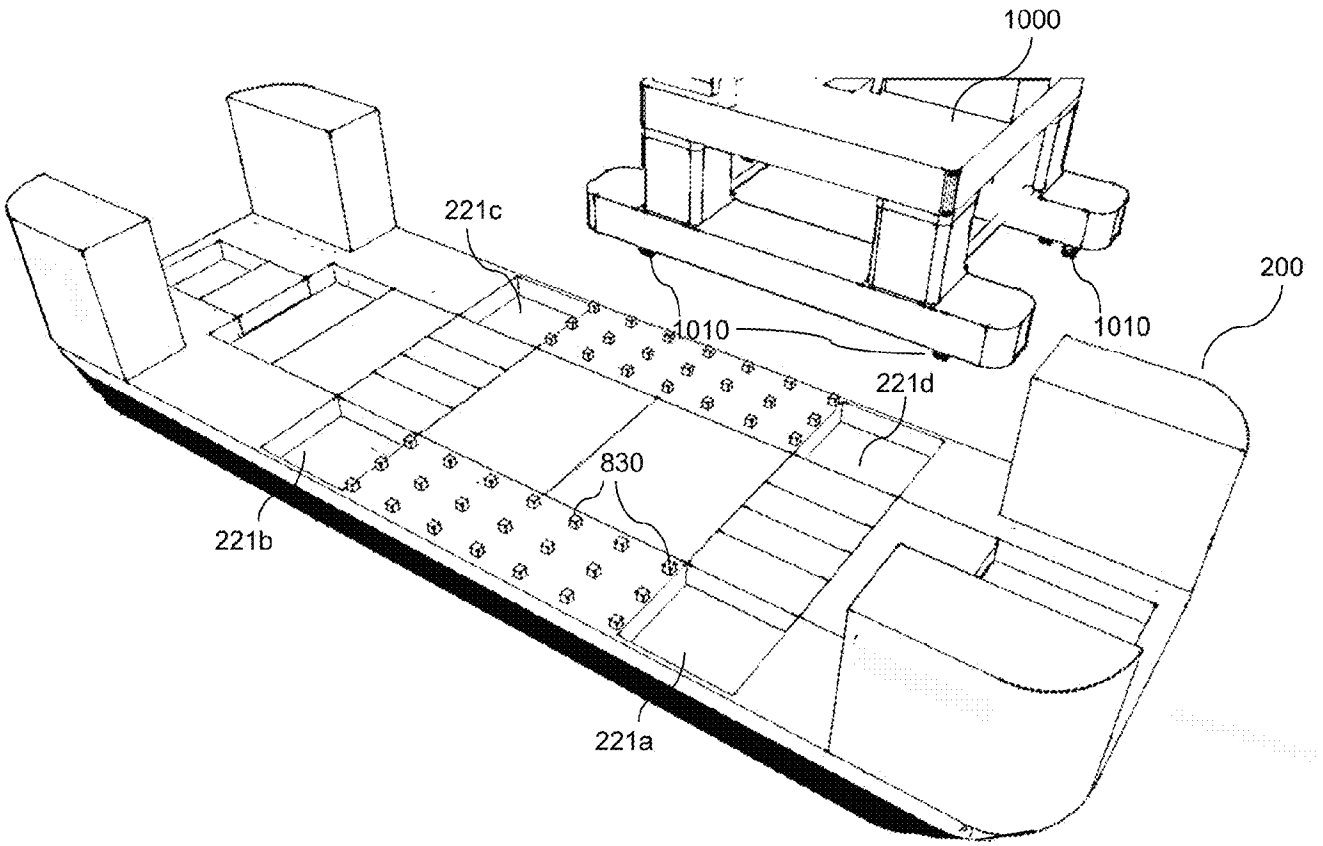
FIG. 14 illustrating a perspective view of the submersible vessel with the deck being prepared for docking of a semi-submersible vessel in accordance with an embodiment of this invention.
Figure 15:
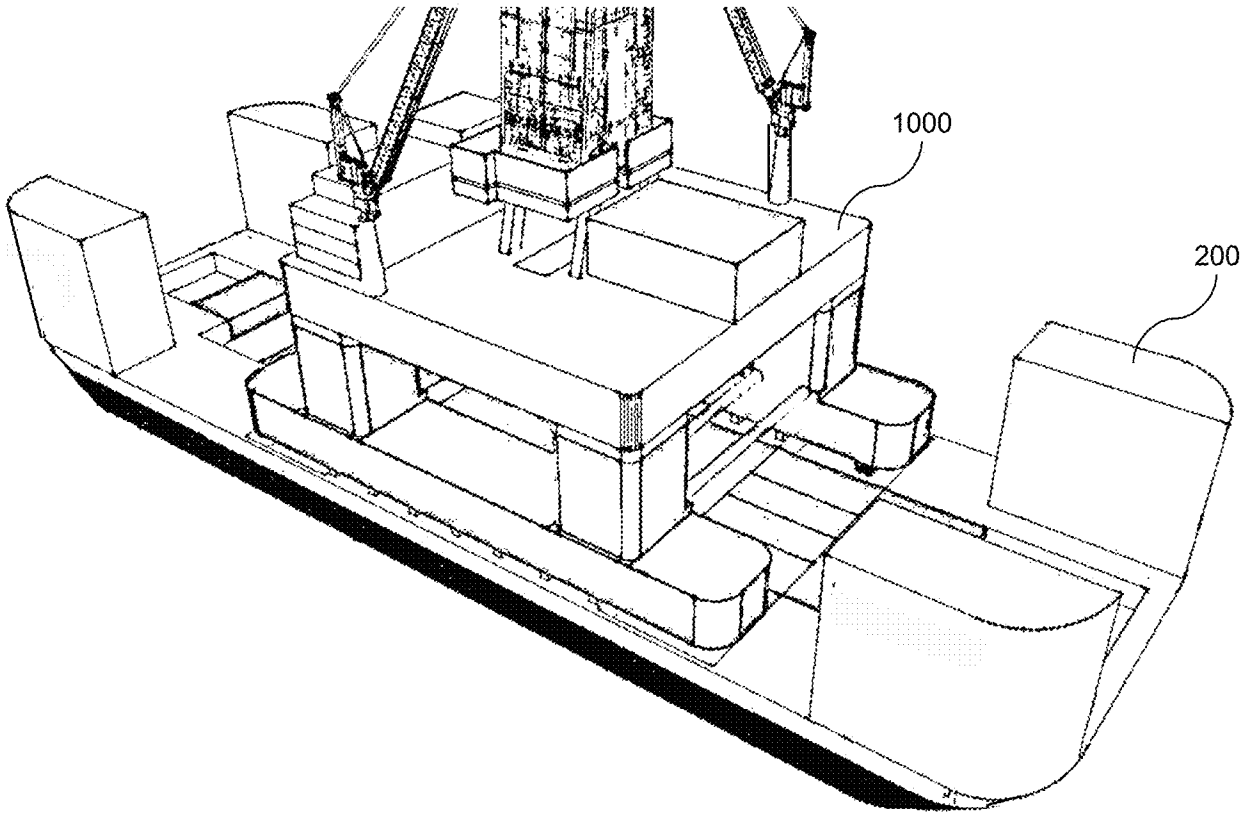
FIG. 15 illustrating a perspective view of the semi-submersible vessel being docked onto the submersible vessel in accordance with an embodiment of this invention.

FIGS. 14 and 15 illustrate a semi-submersible vessel 1000 being docked on the deck 220 of the submersible vessel 200. FIG. 14 shows the blocks 229 being moved to the required setup according to the semi-submersible vessel 1000. Particularly, the blocks 229 are moved to a particular setup to create open hatches 221*a*-221*d* to accommodate the thrusters 1010 of semi-submersible 1000. Keels 830 are laid on the surface of the block 229. FIG. 15 shows the semi-submersible vessel 1000 being docked on the submersible vessel 200.

Figure 16:
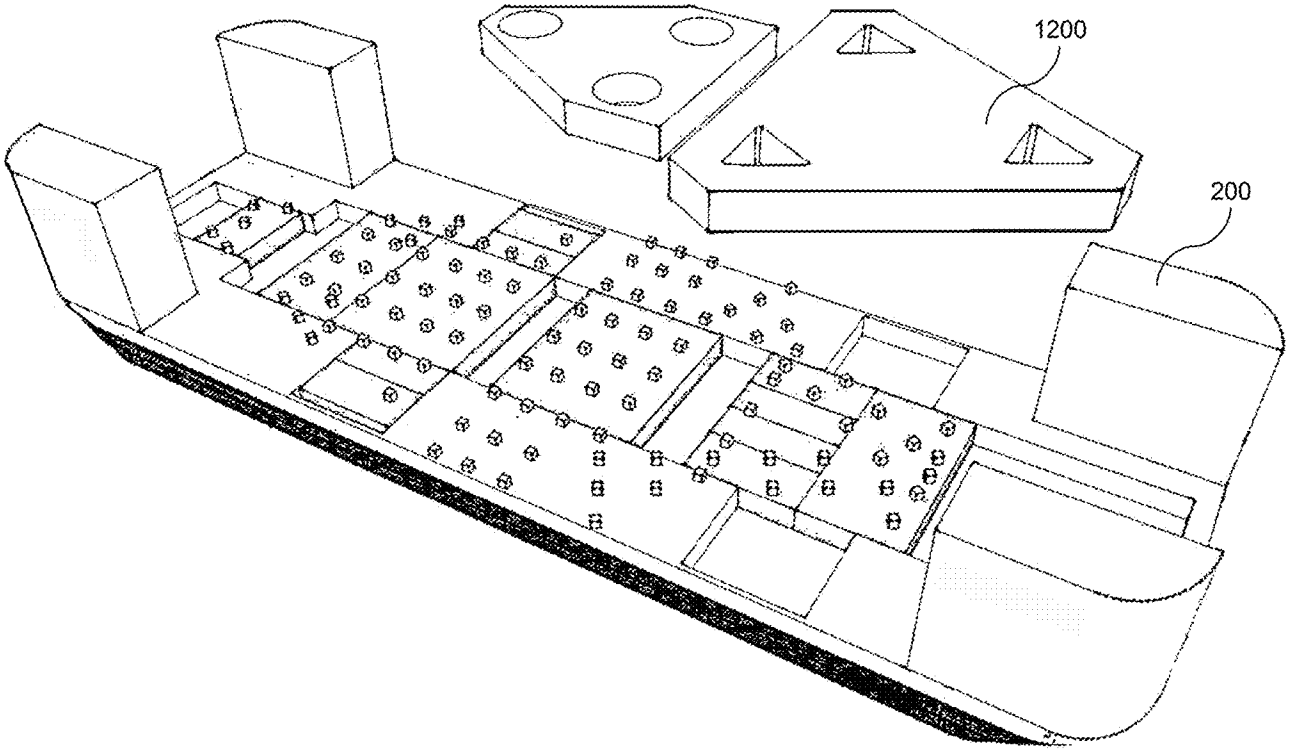
FIG. 16 illustrating a perspective view of the submersible vessel with the deck being prepared for docking of a heavy load in accordance with an embodiment of this invention.
Figure 17:
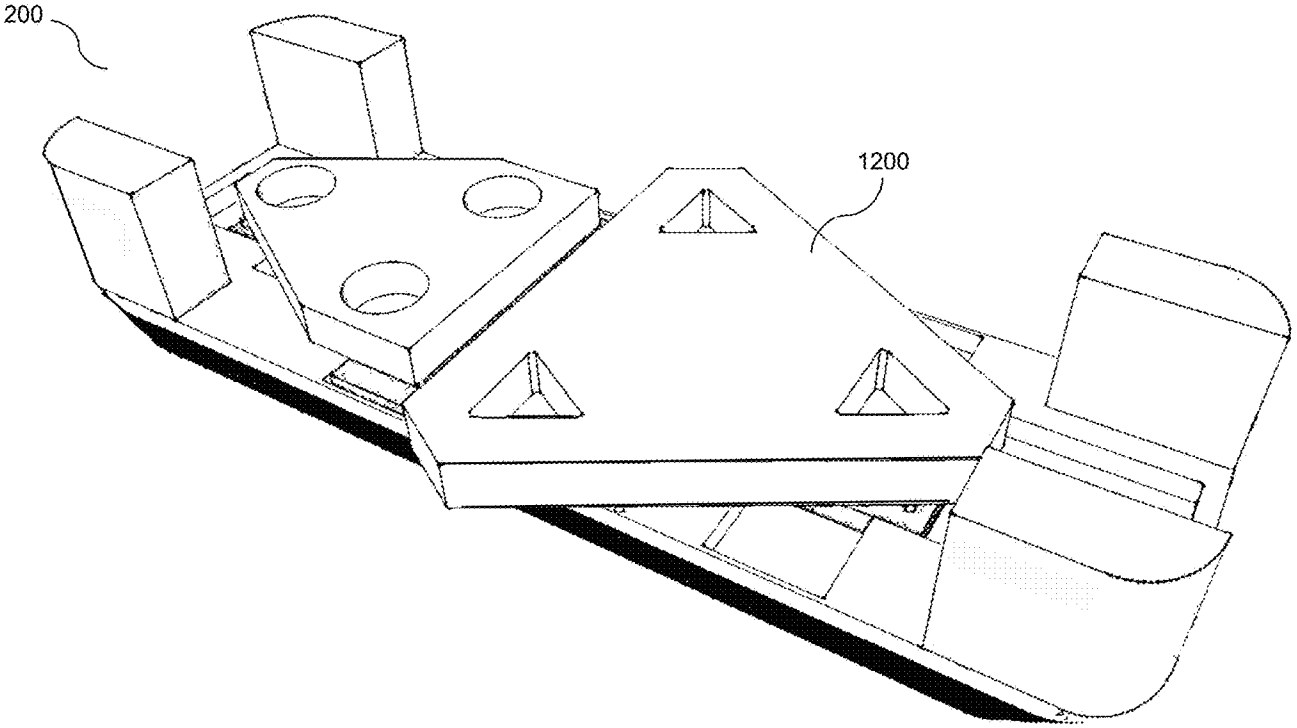
FIG. 17 illustrating a perspective view of the heavy load being docked onto the submersible vessel in accordance with an embodiment of this invention.

Other than docking of vessels, the submersible vessel 100 or 200 can also be configured to transport heavy loads 1200 as shown in FIGS. 16 and 17. Similarly, the blocks 229 are moved to the required setup to accommodate the dimensions of the heavy loads. Keel blocks 830 are then laid on the surface of the blocks 229. The heavy loads 1200 are then laid on the deck 220 of the submersible vessel 200.

In operation, preparation work has to be completed before ballasting to submerge the submersible vessel. The preparation work includes arranging stanchions or markers on the deck. The stanchions or markers act as the x and y positional guides to ensure that the load can be docked at the correct position where the thrusters are above the cavities of the deck. Keel blocks are then laid on the deck. One skilled in the art will recognise that the step of arranging the stanchions or markers and laying of keel blocks may be interchanged or performed concurrently without departing from the invention.

After the preparation work is completed, the submersible vessel 100 or 200 would be ballasted to submerge up to the deck 120 or 220 with an approximate time of 4 hours. The submersible vessel 100 or 200 will continue to submerge to the maximum submergence draft of 33 m, exposing portions of the stabilizing towers 130-133 or 230-233. The submersible vessel 100 or 200 will maintain in this floating condition by tugs or mooring lines depending on operation requirements. The portion of the stabilizing towers 130-133 or 230-233 that are not submerged act as a guide for the vessel to be moved into a position above the deck 120 or 220. The load will be towed to the designated loading position indicated by a few stanchions/markers already in position on the deck 120 or 220.

Once the load is in line with the positional markers, the submersible vessel 100 or 200 will start to de-ballast to the maximum load line draft of 7 meters. Once submersible vessel 100 or 200 reaches the load line draft of 7 meters, the load should be sitting on the keel blocks laid on the deck 120 or 220 with the thrusters above the cavities. Hence, the submersible vessel 100 or 200 is able to dry dock a drill ship or semi-submersible with thrusters without incurring underwater thruster removal cost.

The above is a description of exemplary embodiments of a submersible vessel in accordance with this invention. It is foreseeable that those skilled in the art can and will design alternative structure or assembly based on this disclosure that infringe upon this invention as set forth in the following claims.

The invention claimed is:

1. A submersible vessel for dry docking a vessel, said submersible vessel comprising:

a floating unit;

a deck above said floating unit, said deck having a base, a sidewall along a perimeter of said base and a block provided within said sidewall and resting on said base, said block defining a cavity such that when said vessel is being docked on said deck, a thruster of said vessel is above said cavity; and a plurality of stabilizing towers arranged on said deck.

2. The submersible vessel according to claim 1 wherein said deck further comprises:

a plurality of blocks defining a plurality of cavities.

3. The submersible vessel according to claim 2 wherein each of said plurality of blocks are fixedly secured to said base.

4. The submersible vessel according to claim 2 further comprising truss structures for covering any unused cavities.

5. The submersible vessel according to claim 2 wherein said base is rectangular in shape having rounded edges and said plurality of stabilizing towers are arranged at each of the corners of said base.

6. The submersible vessel according to claim 2 wherein each of said plurality of blocks are identical in dimension.

7. The submersible vessel according to claim 2 wherein each of said plurality of blocks includes rollers.

8. The submersible vessel according to claim 2 wherein said deck further comprises:

guide rails arranged on said base;

rollers arranged on each of said plurality of blocks and coupled to said guide rails such that each of said plurality of blocks is slidably movable on said base.

9. The submersible vessel according to claim 2 wherein said plurality of blocks are made of steel.

10. The submersible vessel according to claim 2 wherein said deck further comprises securing means for securing said plurality of blocks to said base.

11. The submersible vessel according to claim 1 wherein said floating unit is a pontoon.

* * * * *